United States Patent [19]

Abbeloos

[11] 4,124,249

[45] Nov. 7, 1978

[54] SOUND TRANSMITTING SYSTEM

[76] Inventor: Charles J. Abbeloos, 5585 Verdi St., Brossard, Quebec, Canada, J4W 1B4

[21] Appl. No.: 845,257

[22] Filed: Oct. 25, 1977

[51] Int. Cl.[2] ..... A47C 7/42

[52] U.S. Cl. ..... 297/217; 5/317 R; 297/391; 297/457

[58] Field of Search ..... 5/317 R, 341; 297/186, 297/217, 391, 457; 312/8

[56] References Cited

U.S. PATENT DOCUMENTS

| | | | |
|---|---|---|---|
| 3,124,389 | 3/1964 | Mikan | 297/454 |
| 3,156,500 | 11/1964 | Kerr | 297/391 |
| 3,397,286 | 8/1968 | Prewitt et al. | 297/186 |
| 3,922,034 | 11/1975 | Eggert | 297/391 |

*Primary Examiner*—Casmir A. Nunberg
*Attorney, Agent, or Firm*—Daniel Jay Tick

[57] ABSTRACT

A sound transmitting system has a large speaker mounted in a chamber formed in an article of furniture under the thorax area of a person resting on the article of furniture. A pair of arcuate members are mounted on the article of furniture at the person's head and have four distinct loudspeaker chambers enclosed therein for directing multichannel or single channel sound into the ears of the person. Each semicircular arcuate portion has a pair of speakers separated by an internal bulkhead mounted in the chambers thereof.

8 Claims, 3 Drawing Figures

SOUND TRANSMITTING SYSTEM

BACKGROUND OF THE INVENTION

The present invention relates to a sound transmitting system. More particularly, the invention relates to a quadraphonic sound system with direct thoracic stimulation.

The sound transmitting system of the invention reproduces not only the full spectrum of audible sounds usually considered to range from 30 to 20,000 Hz, but also those frequencies below 30 Hz which are called subsonic and considered inaudible, although they are felt by the body during live auditions of bands, pipe and electronic organs, and wind, string and percussion instruments, or during high fidelity electroacoustical reproduction of such instruments at very high sound pressure levels often impossible to attain or tolerate in the home. The sound transmitting system of the invention permits a person to fully enjoy the sensations of the subsonic frequencies as well as the full spectrum of audible frequencies. Because of the close proximity of the sound sources to the user, a realistic effect is obtained with little expenditure of electroacoustic energy. The sound transmitting system of the invention is designated by the word "thaural", which is an acronym composed of "th" of thorax and the word "aural", relating to the ear, in view of the very principle of operation involved and the constructional details of said system. The sound transmitting system of the invention consists basically of an airtight rigid braced couch body with a padded cushion thereon for the comfort of the user. Part of the pad covers a speaker mounted under the area of the thorax of the user, so that subsonic and low sound waves transmitted by said speaker may be felt in the thorax, and thence in the body of the user, thereby adding a physical sensation of the sounds to the aural perceptions of the sounds received by the ears of the user. Furthermore, a set of four speakers, responding to four separate channels, two separate channels feeding the speakers two by two in opposite, left and right pairs, one channel feeding two opposite, or all speakers simultaneously, can be mounted in a shell of oblong configuration around the head of the user. The oblong configuration consists of a pair of arcuate members. The fifth speaker under the thorax uses a center channel, a front two channel mono mix input, or the one channel which also feeds two opposite or all four speakers in the arcuate member around the head of the user.

Due to the use of relatively low audio levels consistent with the proximity of the user to the sound sources and the attainment of the highest sound pressure levels one could wish, as well as full range speakers of the acoustic suspension variety in the arcuate member, there is no need for a crossover network in the device of the invention to permit full spectrum and full loudness outputs to be heard by the user. The big speaker mounted under the thorax preferably transmits only the frequencies of the five lowest octaves or so, of any musical score through the padding to the user, although some transmission of the higher octaves by the large speaker is in no way detrimental to achieving proper "thaural" effect, since most of the higher frequencies are readily absorbed by the padding through which the thorax speaker radiates. In effect, "thaural" sound transmission combines the apparent electroacoustic sources of sound into aural and bodily sensations utilizing eardrum, skin, head, bone and muscular reception in a synergetic manner, thus providing a unique and total experience which no other system accomplishes in a similar fashion. Due to the proximity of the user to the sound sources, the high quality of the sound is not affected in any manner whatsoever by the acoustics of the listening locale or area. Subsonic and sonic frequencies are perceived as inside the body and outside the head, respectively; not within the head alone, as is the case when headphones are used. Since the sounds tend to be confined within the system, the user can enjoy the "thaural" experience loudly, while the sounds in the surrounding area remain at an acceptable level. Furthermore, during many sessions of enjoying "thaural" sound reproduction via the prototype built by the inventor, said inventor enjoyed an aesthetically gratifying experience conducive to a feeling of well being and relaxation. The arcuate members are usable separately from the couch and thorax speaker for use in theaters, vehicles, or the like, for excellent quadraphonic or stereophonic reproduction. When the arcuate members are used separately, the low frequencies of the audio signals are perceived only aurally, not "thaurally" as with the complete system. For this reason, a speaker suitable for effective and efficient reproduction of the lowest octaves of musical material, including that generated by synthetic means, may be mounted, in accordance with the "thaural" principle disclosed herein, in any article of furniture, such as a seat or couch type device for "thaural" enjoyment of sounds, either in conjunction with the arcuate members as described, stereophonic or quadraphonic headphones, or the usual type of loudspeaker enclosures used at the present time for room filling diffusion.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
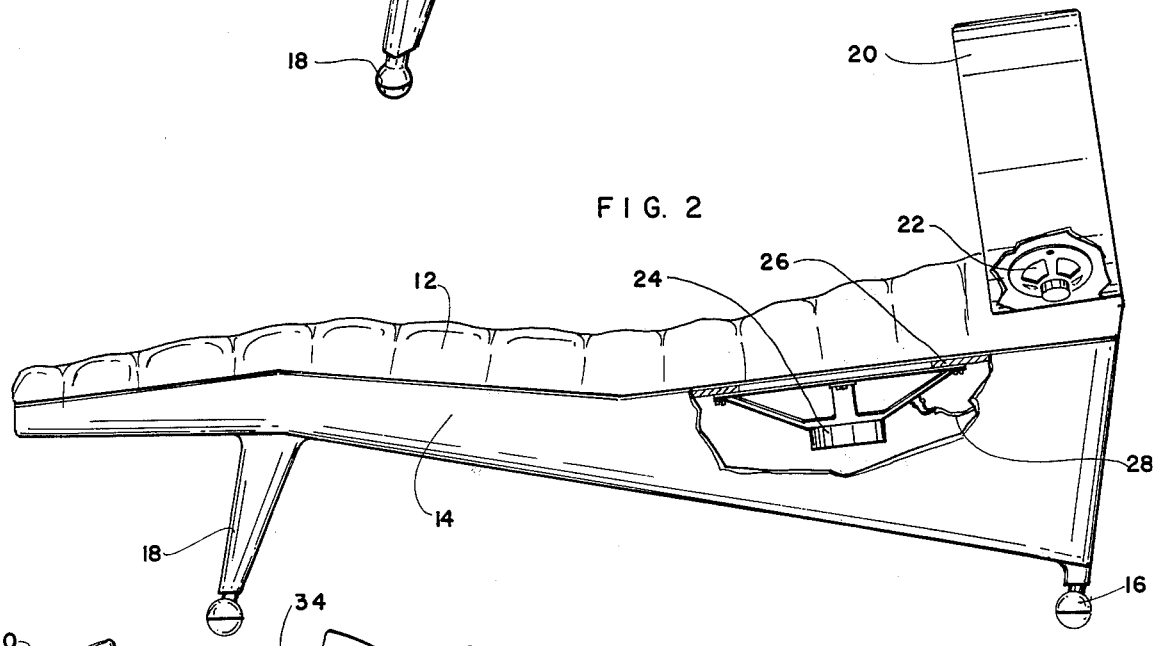
FIG. 2 is a side view, partly cut away and partly in section, of the embodiment of FIG. 1.
Figure 3:
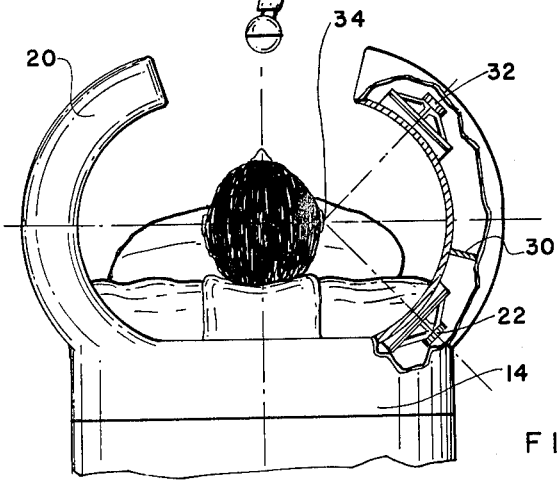
FIG. 3 is an end view, partly cut away and partly in section, of the embodiment of FIG. 1, in use.

The sound transmitting system of the invention is for entertaining and relaxing a person 10 resting on an article of furniture 14 such as, for example, a couch, as illustrated in the FIGS., from an outside audio source (not shown in the FIGS.) The article of furniture 14 may comprise a couch, sofa, reclining chair, and the like, a seat in a public place, or the like, or a seat in a vehicle, craft, vessel, and the like, The person 10 has a body with a thorax, a head and ears 34 on the head (FIG. 3). The couch 14 has a surface, covered by a resilient pad 12 (FIGS. 1 to 3) which supports the person 10. A chamber (FIG. 2) is formed in the couch 14 under the area of the thorax of the person 10.

The sound transmitting system of the invention comprises a thorax speaker 24 mounted in the chamber formed in the article of furniture or couch 14, as shown in FIG. 2. The thorax speaker 24 is positioned to broadcast sound toward the thorax of the person 10 on the surface of the couch 14.

Figure 1:
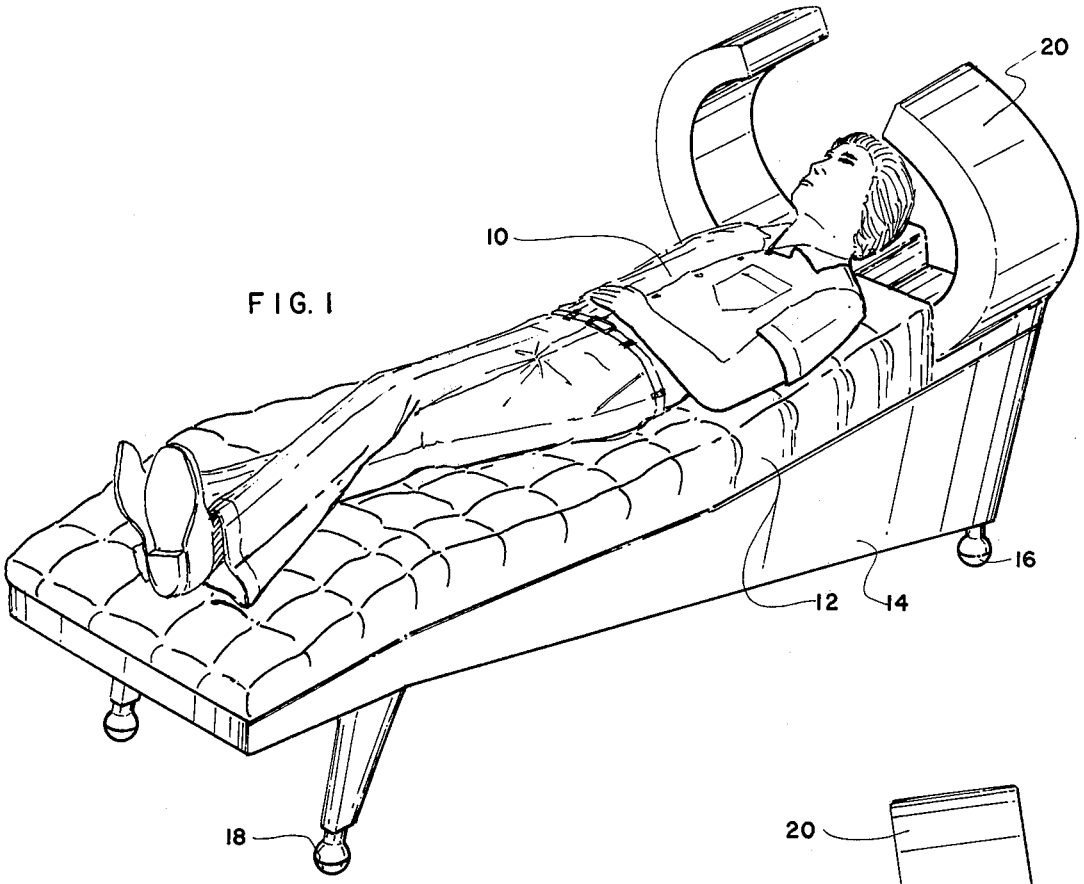
FIG. 1 is a perspective view of an embodiment of the sound transmitting system of the invention, in use.

A pair of arcuate members 20 are substantially coplanarly mounted on the article of furniture 14 (FIGS. 1 to 3) at the head of the person 10, but spaced therefrom, as shown in FIGS. 1 and 3, The arcuate members 20 are of essentially semicylindrical configuration, as shown in the FIGS. Each of the arcuate members 20 extends at a corresponding side of the person's head.

The arcuate members 20 have free ends spaced from each other above the head of the person 10 and spaced therefrom, as shown in FIGS. 1 and 3. Each of the arcuate members 20 has a pair of independent airtight chambers formed therein by a bulkhead 30, as shown in FIG. 3. The arcuate members 20 are either permanently or removably affixed to the article of furniture 14.

As shown in FIG. 3, one of the chambers of each of the arcuate members 20 is in a first portion of the arcuate member close to the article of furniture 14. The other of the chambers of each of the arcuate members 20 is in a second portion of the arcuate member in the area of the free end thereof. The bulkhead 30 in each of the arcuate members 20 separates the chambers of the arcuate member.

A plurality of speakers 22, 32 and so on, are mounted in the arcuate members 20 (FIG. 3) and are positioned to broadcast sound toward the ears 34 of the person 10. The speaker 22 is mounted in the airtight chamber of the first portion of each of the arcuate members 20 and the speaker 32 is mounted in the airtight chamber of the second portion of each of said arcuate members, as shown in FIG. 3.

The speakers 22, 32, and so on, and the thorax speaker 24 are electrically connected to the outside audio source via electrical conductors 28, and so on (FIG. 2), so that the person 10 hears stereophonic sound, including high and low frequencies, from the plurality of speakers. The person 10 simultaneously feels low frequency sound via the thoracic region of the body.

The speaker 22 in the chamber of the first portion of each of the arcuate members 20 is angled upward to an ear 34 of the person 10 and the speaker 32 in the chamber of the second portion of each of said arcuate members is angled downward to an ear 34 of said person, as shown in FIG. 3.

The couch 14 in the illustrated example of the FIGS. is of wedge shape and is supported by short rear legs 16 and long front legs 18 (FIGS. 1 and 2).

The thorax speaker 24 is affixed to the couch 14 via supports 26, as shown in FIG. 2, to protect said speaker from damage due to pressures exerted by the body of the person 10.

Since each of the speakers 22, 32, and so on, occupies a self-contained airtight enclosure, the separate channels fed to each of said speakers is separately perceivable by the ears 34 of the person 10. The height of the arcuate members 20 above the couch and the angular position of each of the speakers 22, 32, and so on, relative to the horizontal, provide focussing of the sounds produced by said speakers at the ears 34 of the person 10.

Having described a preferred embodiment of my invention, it is understood that various changes can be made without departing from the spirit of my invention, and I desire to cover by the appended claims all such modifications as fall within the true spirit and scope of my invention.

What I claim and seek to secure by Letters Patent is:

1. A sound transmitting system for entertaining and relaxing a person resting on an article of furniture from an outside audio source, said person having a body with a thorax, a head and ears on the head and said article of furniture having a surface supporting the person and a chamber formed therein under the area of the thorax of the person, said sound transmitting system comprising a thorax speaker mounted in the chamber formed in the article of furniture and positioned to broadcast sound toward the thorax of the person on the surface of said article of furniture;

a pair of arcuate members substantially coplanarly mounted on said article of furniture at the head of the person but spaced therefrom, said arcuate members being of essentially semicylindrical configuration each extending at a corresponding side of the person's head, said arcuate members having free ends spaced from each other above the head of the person and spaced therefrom, each of said arcuate members having chambers formed therein; and a plurality of speakers mounted in the arcuate members and positioned to broadcast sound toward the ears of the person, the plurality of speakers and the thorax speaker being electrically connected to the outside audio source whereby the person hears stereophonic sound including high and low frequencies from said plurality of speakers and feels low frequency sound via the thoracic region of the body.

2. A sound transmitting system as claimed in claim 1, wherein each of said arcuate members has a pair of independent airtight chambers therein and a speaker is mounted in each of said airtight chambers.

3. A sound transmitting system as claimed in claim 1, wherein the article of furniture comprises a couch, sofa, reclining chair, and the like.

4. A sound transmitting system as claimed in claim 1, wherein the article of furniture comprises a seat in a public place.

5. A sound transmitting system as claimed in claim 1, wherein the article of furniture is a seat in a vehicle, craft, vessel, and the like.

6. A sound transmitting system as claimed in claim 1, wherein said arcuate members are removably affixed to said article of furniture.

7. A sound transmitting system as claimed in claim 2, wherein one of the chambers of each of said arcuate members is in a first portion of said arcuate member close to said article of furniture and the other of said chambers is in a second portion of said arcuate member in the area of the free end thereof, and further comprising a pair of bulkheads each separating the chambers in a corresponding one of said arcuate members.

8. A sound transmitting system as claimed in claim 7, wherein the speaker in the chamber of the first portion of each of said arcuate members is angled upward to an ear of the person and the speaker in the chamber of the second portion of each of said arcuate members is angled downward to an ear of said person.

* * * * *